United States Patent [19]

Lion et al.

[11] 4,258,851

[45] Mar. 31, 1981

[54] RAISIN SEPARATING MACHINE

[76] Inventors: Herbert A. Lion, 4855 E. Townsend Ave.; Alfred Lion, Jr., 5493 E. Heaton Ave., both of Fresno, Calif. 93727

[21] Appl. No.: 53,959

[22] Filed: Jul. 2, 1979

[51] Int. Cl.[3] ..... B07C 9/00

[52] U.S. Cl. ..... 209/700; 209/687; 209/932; 209/3.1; 209/380

[58] Field of Search ..... 209/606, 932, 700, 687, 209/3.1, 699, 691, 692, 693, 690, 380, 270, 689

[56] References Cited

U.S. PATENT DOCUMENTS

| | | | |
|---|---|---|---|
| 1,438,861 | 12/1922 | Root | 209/380 X |
| 2,653,521 | 9/1953 | Ahlfors | 209/270 |
| 2,966,988 | 1/1961 | Nury et al. | 209/700 X |
| 3,259,241 | 7/1966 | Hughes | 209/690 |

*Primary Examiner*—Allen N. Knowles

*Attorney, Agent, or Firm*—Gerard and Sepulveda

[57] ABSTRACT

Herein described is a machine for removing raisins spoiled by mold from good raisins. An angularly disposed rotating screened cylinder causes raisins to be lifted and dropped to the bottom of the cylinder. Because of the fact that the bad raisins are soft and sticky they will stick to the screen. Good raisins will be tumbled towards the bottom of the screened cylinder and out. Spray nozzles force water through the screened cylinder washing the stuck raisins into a trough where they are kept separate from the good raisins.

20 Claims, 4 Drawing Figures

RAISIN SEPARATING MACHINE

BACKGROUND OF THE INVENTION

This invention relates to machinery used in connection with packing and processing produce, and more particularly, to a novel and improved machine for use in removing or culling undesirable produce from the desirable produce.

In the instant embodiment shown, a device will be described and shown which is useful in culling raisins and specifically for removing raisins that are bad, by excessive mold, from those raisins which are good.

It is known in the prior art that raisins which are subjected to mold have a softer and inferior skin and that the insides of the raisins are very soft. Thus, subjecting these raisins to extremely hot water pressure causes the skin on the inferior raisins to break and leaves a soft, pliable substance from the raisins. Now the soft, pliable raisins are removed sometimes by the water, but in most cases they are very difficult to remove.

Problems occur with the mold is that the bad raisins or moldy raisins become soft and sticky and become subjected to rot. Should these bad raisins be allowed to ramin with the good ones, the entire stock of raisins in the lot may become bad.

The United States Department of Agriculture has set certain standards as to the percentage of bad raisins in the good raisins, and that standard has normally been below 4%. Oftentimes, it has been found that the percentage of bad raisins may reach as high as 60%, but in most cases after considerable rain damage, rain and moisture, they will remain around 40%.

As is known, raisins are made by removing ripe grapes from the vines and placing them on drying trays right in the field. The grapes are then allowed to dry in the sun. In most cases because the grapes are ripe in the dry season, no harm comes to the raisins because of rainfall, but in special unusual weather some of the raisins in some area may be caught in an unusual or early rain. The rainfall or the moisture causes the mold in the raisins while they are drying on trays in the field.

Oftentimes, the farmers find it desirable to wait as long as they can before they harvest the grapes for drying to make the raisins. The reason for allowing the grape to stay on the vine as long as possible is that it improves the sugar content, and hence, the weight of the raisins, causing an economic gain to the farmer. Should the grape be harvested early, the grapes do not have the high sugar content, and thus, they are skinny and do not maintain the desired weight.

The problem of waiting too long for the grape to gain desired sugar content and plumpness for the use in the raisins, is that usually it causes the drying raisins to approach the rainy seasons. When the rainy seasons do come, the moisture causes the mold on the raisins at an undesirable level.

At one time when the raisins were in the unacceptable range, that is above the 4% level, they were discarded and literally plowed under in the fields. Presently the raisins are culled over by hand, and that is, the bad raisins are removed from the good raisins by manual labor.

Yet to discard the good raisins just because there happens to be a high mold content in the entire overall batch is wasteful and creates an economic loss to the farmer.

Heretofore there has been no mechanized and automatic system for removal of the bad raisins from the good ones. Thus, it would be desirable to have a mechanized and automatic system whereby the bad raisins are separated from the sound raisins, so that the crops of raisins can be partially saved, thus saving the farmer from the economic losses created by having to discard his crop.

SUMMARY OF THE INVENTION

Briefly described, the present invention provides equipment for processing produce, and in the particular embodiment shown, equipment for processing raisins to remove therefrom raisins which have become spoiled due to mold. Basically, the invention includes a rotatable screened cylinder being mounted for rotation at an angle wherein one end of the cylinder is adapted to receive the raisins on the upper end and dispose of the raisins on the lower end. A plurality of spaced ribs are longitudinally disposed within the cylinder, on the inner side thereof, which lift the raisins and drop them to the bottom of the cylinder. The dropping of the raisins to the bottom of the cylinder causes the spoiled, soft, sticky raisins, which have heretofore been conditioned by hot water, to stick to the bottom of the screen and the raisins with strong skins remain losse from the screen. A plurality of spray nozzles are disposed on the outside of the cylinder and directed to cause a spray of water along a longitudinal line on the outside of the screen. A chute is disposed inside the cylinder and directly under the longitudinal line of the spray created by the spray nozzles. As the water from the spray nozzles washes the spoiled raisins that have stuck to the screen of the cylinder, they are washed into the chute and disposed of in a suitable manner. Meanwhile, the good raisins, that is, those with the firm skin that do not stick to the screen, are again lifted by the ribs within the cylinder and again dropped to the bottom of the screen.

For each revolution of the cylinder, the raisins are advanced downwardly towards the bottom of the angled cylinder until finally they are removed from the lower end thereof. But, each time that the ribs lift the raisins, they are again dropped firmly to the bottom of the screen. It has been found that with appropriate rotation of the screen, and angle thereof, that a desirable travel of the raisins is one foot per revolution. Thus, the raisins are "processed" on a 12 foot cylinder 12 times, before they are finally disposed of. It has been found that by using this method the raisins can then adhere to the required Department of Agriculture standards, that is, 4% mold per volume.

DESCRIPTION OF THE DRAWINGS

These and other features and advantages will become more apparent to those skilled in the art, when taken into consideration with the following detailed description, wherein like reference numerals indicate like and corresponding parts throughout the several views, and wherein.

DESCRIPTION OF THE PREFERRED EMBODIMENT

Figure 1:
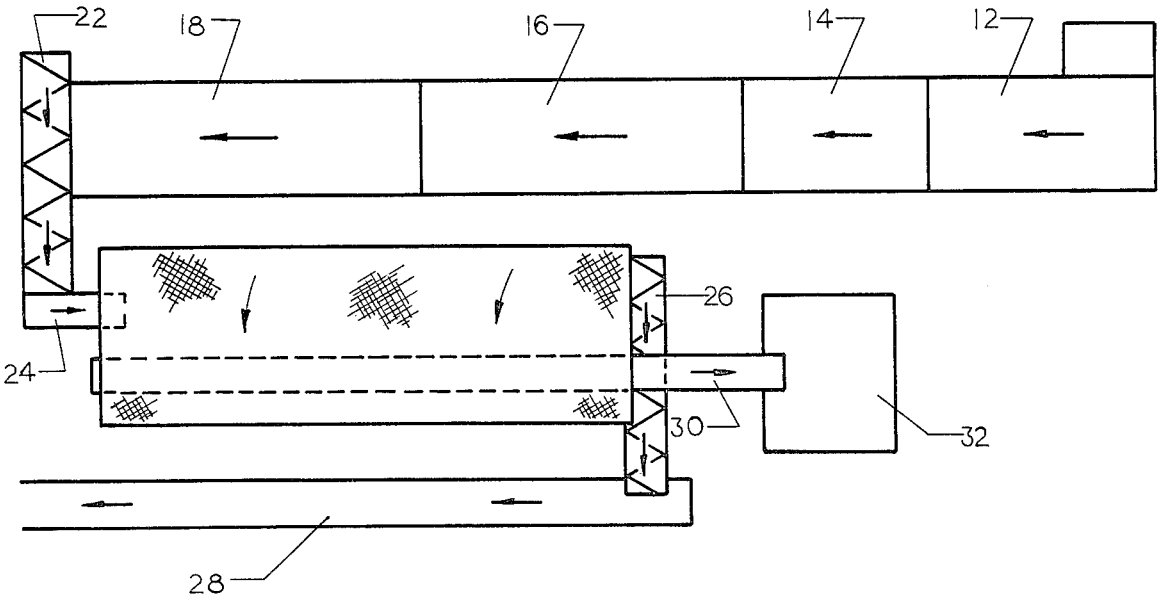
FIG. 1 is a block diagram illustrating the present invention in a raisin processing assembly line.

Referring now to FIG. 1 there is shown, in a somewhat schematic form of a block diagram, the step by step process of a processing system for treating raisins included in the present invention. Raisins are first received in a bin and are lifted on an elevator, 12. Then by rollers, belts or suitable means, they are progressingly moved on to a vibrator 14, where they are then substantially agitated so that the raisins are spread about and certain raisins, which include undesirable portions thereof, can be easily removed. In the next step, the raisins are moved to an overhead spray area where they are sprayed with hot water, this is done in station number 16 and 18 whereby the hot water will soften the skins of the raisins which are affected by mold and cause them to break down and actually tear apart in most cases. The sound raisins have a very tough skin, and will not be damaged by the hot water spray. Next the raisins are dumped into a auger feed 22 which is of the type well known to those skilled in the art, which is a spiral type apparatus which pushes the raisins sideways into a delivery chute 24. Here the raisins are then fed through the separating processor as will herein after be explained in accordance with this invention.

The good raisins are then fed onto a bottom trough 26, which also has a feed auger therein which forces the good raisins received from the bottom of the processing equipment and places them on a return chute 28 whereby they are then sent to the packing line.

Raisins while are affected by mold are then fed from a chute 30 into a receptacle or bin 32 whereby the undesirable collection can be disposed in a suitable manner.

Figure 2:
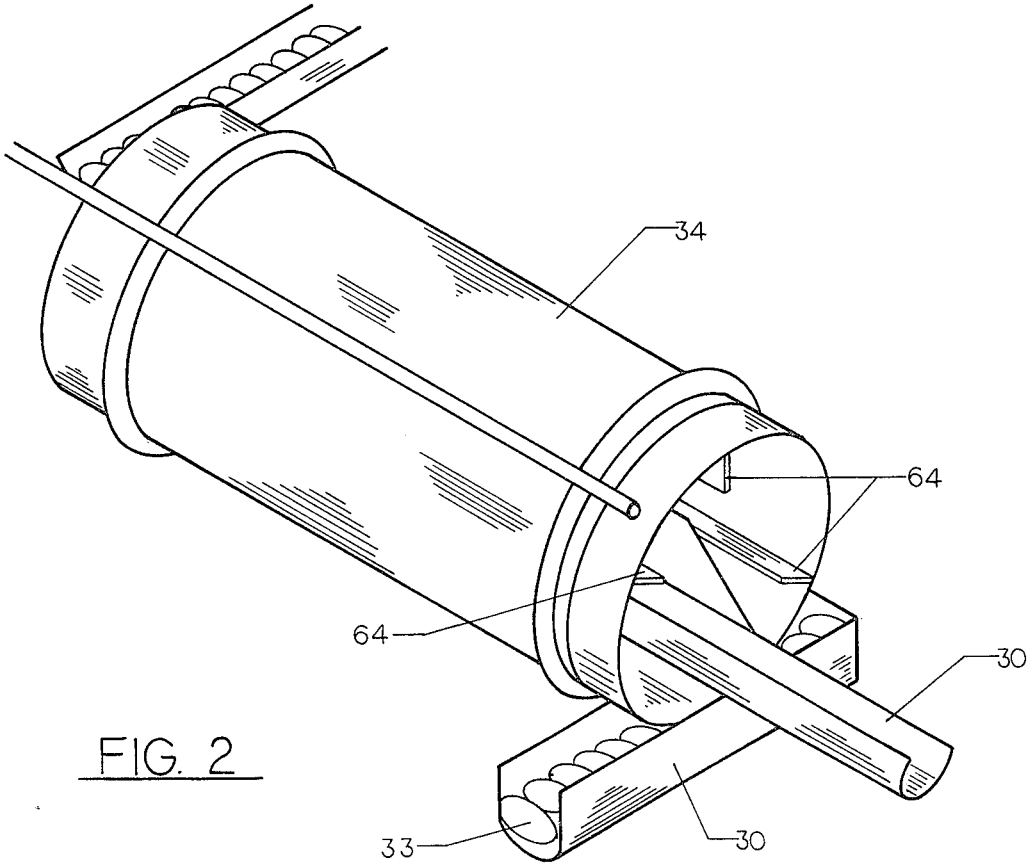
FIG. 2 is a perspective view of the shown embodiment of this invention.
Figure 3:
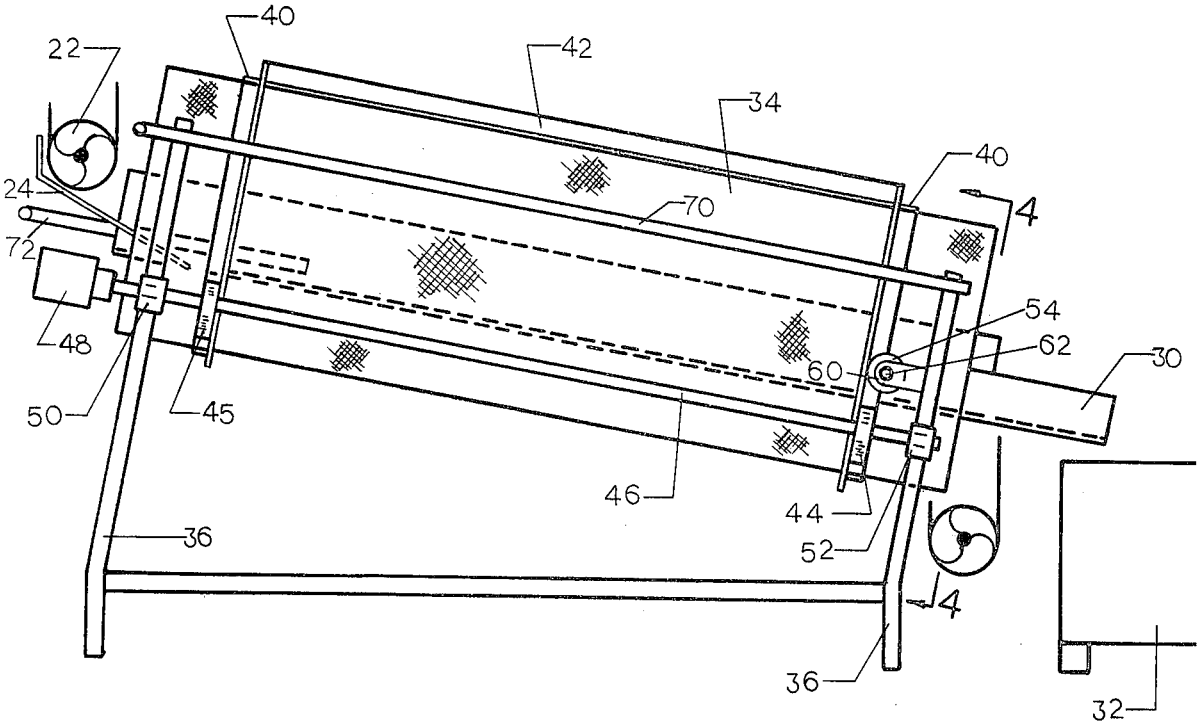
FIG. 3 is a side view of the shown embodiment of this invention.
Figure 4:
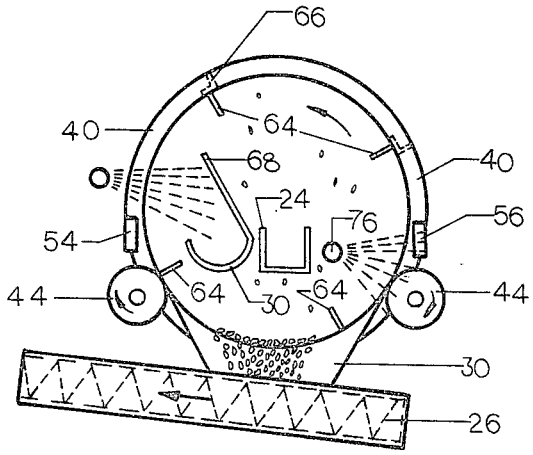
FIG. 4 is a front view taken along the lines 4—4 of FIG. 3.

Referring now to FIG. 2, there is shown a cylinder 34, which may be comprised of an elongated stretch of matters, not shown, which will keep the cylinder 34 in a substantially circular elongated construction. The cylinder 34 is mounted on a suitable mounting structure 36, as shown in FIG. 3, whereby an angular relationship of the cylinder 34 is provided so that raisins provided to the input chute 24 by the rotating auger 22, will be fed onto the bottom of the screened cylinder 34.

A pair of tracks 40 and 42 are provided on the outside circumference of the cylinder 34, and encircle the entire outside periphery of the cylinder 34, and are held intact in a suitable manner, specifically such as by the use of the ribs 42. A rotating wheel 44, is provided on two ends of the shaft 46 and driven by a drive motor 48. The drive wheels 44 and 45 are in contact with the tract 40 and as the wheels 44 and 45 rotate, they cause the entire cylinder 34 to rotate accordingly. The shaft 46 is secure to the frame 36 by the journals 50 and 52 which includes bearings therein so that the shaft 46 will rotate therewith.

Stabilizing wheels 54 and 56 are connected by means of the bracket 60 and axial 62 which are placed against a top rib of the tract 40 to, in effect, secure the rotating cylinder 34 thereon, so that, as the rotating cylinder rotates on its axis it will bear against the wheel 54, preventing the forward movement of the cylinder 34. As can be seen, the rotating cylinder 34 more or less is cradled on the four wheels 44, on the bottom half thereof and on wheels 45 on the top half thereof and rotated thereby. The cylinder 34 is held in its angular position, that is, from moving forward, by bearing against the outer periphery of the wheel 44 and 45, by the stabilizing wheels 54 and 56.

Within the cylinder 34, there are a plurality of spaced ribs or shelves 64 which are connected to the inside of the cylinder 34 and extend inwardly towards the center thereof. Each shelf 64 is connected to an angle iron 66 extending the entire inside length of the cylinder 34, thus, as raisins are fed onto the chute 34 and into the bottom of the cylinder 34, raisins are trapped by the shelves or ribs 64 and lifted upwardly until the shelves 64 reach a level. Thereafter the raisins will drop from the top of the cylinder 34 to the bottom and are actually propelled thereagainst. Those raisins which have a hard and somewhat firm skin will again be lifted by the shelves 64 and again propelled towards the bottom. Those raisins which are spoiled due to mold and softened by the hot water of the overhead sprays at station 16 and 18 of FIG. 1 will become stuck and lodged to the screen material wrapped around the cylinder 34. Thus, as the cylinder 34 rotates the raisins are actually lifted a number of times and if the length of the cylinder is sufficient, and the speed is controlled, it has been found that a 12 foot long cylinder will actually lift the raisins approximately 12 times and hurl them towards the bottom of the cylinder, that is, once for every foot.

The good raisins are then dropped out the chute 30, and moved by the auger 33, as best shown in FIG. 2, and placed on the conveyor belt 28, to the packing line.

The next step used herein is to remove the bad raisins from the screen. This is accomplished by the use of a chute 31 which extends the entire distance of the inside of cylinder 34 and positioned to the left of center as dictated by the direction of rotation of cylinder 34. A back plate 68 is connected or positioned substantially near one side of the cylinder and specifically the side closer to the center line and angularly disposed along the entire length of the cylinder 34. A pipe 70 extends along the outside of the entire cylinder 34, and positioned at a location directly in alignment with the chute 31 and back pleate 68. Disposed along the pipe 70, is a plurality of spaced spray nozzles. Water is fed to the pipe under pressure said through and nozzles. The water spray from the nozzle is directed against the outside of the screen and washes the raisins that are stuck thereto against the back plate 62 and into the chute 31. It may be desirous that water or some other means is used at the top of the chute 30 as provided by the pipe 72 to literally wash the bad raisins down the chute and into the bin 32 whereby they can be carted away and discarded.

It may be desirous to provide a second pipe 76 inside of the screened cylinder 34, which also has a plurality of spray nozzles thereon and will spray against the inside of the screen. This spray nozzle may be positioned in the lower right hand corner of the screened cylinder 34, dictated by the direction of rotation thereof which is used to cause the molded raisins to adhere to the screen so that they will not drop off from the shelves 64 as they are lifted.

Having thus described but one preferred embodiment of this invention, what is claimed is:

1. In a raisin culling machine for removing raisins spoiled by mold or the like from raisins which are still acceptable for consumption, said machine including;

a rotatable cylindrical member being mounted on an angle and having a plurality of orifices therein, for tumbling raisins therein;

means disposed in said member for lifting the raisins in said member a portion of the way around the inside perimeter of the cylindrical member when said member is rotating and dropping said raisins to the bottom of said member causing the raisins spoiled by mold to adhere to the orifices of said rotatable member;

means disposed on the outside of said member for directing a fluid against said member for dislodging said raisin from said rotatable member; and a means disposed in said member and in alignment with the fluid for catching the raisins dislodged thereby.

2. The raisin culling machine as defined in claim 1 and wherein said rotatable member being a screened cylinder.

3. The raisin culling machine as defined in claim 2 wherein said screened cylinder being mounted for rotation at an angle and being adapted to receive the raisins in the cylinder at the top thereof whereby said raisins will progress down the cylinder as it is rotated.

4. In a raisin culling machine for removing raisins spoiled by mold or the like from raisins which are still acceptable for consumption, said machine including:

a rotatable cylindrical member being mounted on an angle and having a plurality of orifices therein for tumbling raisins therein;

means disposed in said member for lifting the raisins in said member a portion of the way around the inside perimeter of the cylindrical member when said member is rotating and dropping the raisins to the bottom of the member for causing the raisins spoiled by mold to adhere to the orifices of said rotating member;

first means disposed on the outside of said member for directing a fluid against said member for dislodging said raisins from said rotatable member;

means disposed in said member and in alignment with the fluid for catching raisins dislodged thereby;

second means disposed within said rotating cylindrical member for directing a fluid against the inside of said member to cause the spoiled raisins to adhere to said orifices therein.

5. The raisin culling machine as defined in claim 4 wherein said rotatable member being a screened cylinder.

6. The raisin culling machine as defined in claim 5 and wherein said means for lifting said raisins in said member being a plurality of spaced shelves being longitudinally disposed therein whereby the raisins are caught in said shelves and are lifted inside the member until they reach a point when the raisins will fall to the bottom of said member.

7. The raisin culling machine as defined in claim 6 wherein said screened cylinder being mounted for rotation at an angle and being adapted to receive the raisins in the cylinder at the top thereof whereby said raisins will progress down the cylinder as it is rotated.

8. The raisin culling machine as defined in claim 7 wherein said first means disposed on the outside of said cylindrical rotating member for directing a fluid against said cylinder including a plurality of longitudinally spaced spray nozzles constructed and arranged to cause a spray of water under pressure against the outside of said rotatable member and spray water through the orifices therein to dislodge raisins which are lodged therein and drop them into said means for catching the raisins dislodged thereby and said second means disposed within said cylindrical rotating member for directing a fluid against the inside of said rotating cylindrical member to cause the spoiled raisins to adhere to said cylinder.

9. The raisin culling machine as defined in claim 8 wherein said means for catching the dislodged raisins including an elongated trough disposed within said member and being aligned to be directly under the plurality of longitudinally spaced spray nozzles to segregate the raisins dislodged from its rotating member from the raisins not lodged to said member.

10. The raisin culling machine as defined in claim 9 wherein said rotatable member being a screen cylinder mounted for rotation at an angle and being adapted to receive the raisins in the cylinder at the top thereof whereby said raisins will progress down the cylinder as it is rotated.

11. The raisin culling machine as defined in claim 8 wherein said means for lifting said raisins in said rotatable screened cylinder being a plurality of spaced shelves being longitudinally disposed within the inside of said rotatable cylinder which lift the raisins within the cylinder to a position whereby they will drop from the shelves to the bottom of the cylinder and the raisins which are spoiled by mold will become stuck to the screened cylinder and be washed into said chute by said plurality of spaced spray nozzles.

12. The raisin culling machine as defined in claim 10 and further including a plurality of longitudinally spaced spray nozzles disposed on the inside of said screened cylinder constructed and arranged to cause a spray of water under pressure against the inside of said screened cylinder to cause said spoiled raisins to adhere to the screen of said screened cylinder, said plurality of longitudinally disposed spray nozzles being disposed near the bottom of said screened cylinder and off center therefrom so that the spray is against the inside of said screened cylinder as it rotates upwardly.

13. In a raisin culling machine for removing raisins spoiled by mold from sound raisins:

a rotatable screened cylinder being mounted for rotation at an angle and adapted to receive the raisins on the upper end and dispose of the raisins on the lower end;

a plurality of spaced ribs longitudinally disposed within said cylinder for lifting said raisins and dropping them on the bottom of said cylinder and causing said spoiled raisins to stick to said cylinder;

a plurality of spray nozzles disposed on the outside of said cylinder and directed to cause a spray of water along a longitudinal line above said cylinder; and a chute disposed within said cylinder and directly under the longitudinal line of water created by said spray nozzle whereby said spoiled raisins stick to said screened cylinder and are washed into said chute.

14. The raisin culling machine as defined in claim 13 and further including a second plurality of spray nozzles disposed on the inside of said cylinder and directed to cause a spray of water along a longitudinal line inside said cylinder to cause the spoiled raisins to stick to the screen of said cylinder.

15. In a raisin culling apparatus for separating raisins which are spoiled by mold from raisins which are sound whereby the raisins spoiled by mold have soft skins and become soft and sticky, said apparatus including:

mounting structure;

a screened cylinder being mounted on said mounting structure for rotation and being disposed at an angle, said cylinder having a top open end and a bottom open end, and a longitudinal center line axis through the angularly disposed cylinder;

means for rotating said cylinder on the centerline axis thereof;

an elongated inner chute disposed within the inside of said cylinder and extending between the first end and the second end thereof and being disposed on one side of the centerline away from the direction of rotation of said cylinder;

a plurality of spaced shelves extending outwardly from the inside of said cylinder for lifting the raisins and dropping said raisins to the bottom of the cylinder, and causing said soft, sticky raisins to become lodged to the screened cylinder; and a plurality of spray nozzles disposed on the outside of said screened cylinder and aligned over said elongated inner chute for directing a spray of water under pressure against the screened cylinder to dislodge the raisins stuck to said screen and drop them into said chute.

16. In a raisin culling apparatus for separating raisins which are spoiled by mold from raisins which are sound whereby the raisins spoiled by mold have soft skins and have become soft and sticky:

a mounting structure;

at least two pair of spaced wheels rotatably mounted on said structure for forming a rotatable bed, one pair of said pair of spaced cylinders being disposed on a plane higher than the second pair of spaced wheels;

a rotatable screened cylinder having a pair of spaced tracks around each circumferential end thereof, said screened cylinder being disposed on said mounting structure whereby one of said pair of spaced wheels engage one of said pair of tracks and the other of said pair of spaced wheels engage the other of said spaced tracks whereby said rotatable screened cylinder is angularly disposed on the mounting structure having a first end on a plane higher than a second end thereof, said rotatable screened cylinder having a center axis;

means coupled to said wheels causing said two pair of spaced wheels and said rotatable screen to rotate in a preferred direction;

an input chute disposed on the first end of said rotatable cylinder for delivering unculled raisin into said rotatable screened cylinder;

a plurality of inner shelves disposed within said cylinder, each shelf of said plurality of shelves being disposed to extend inwardly towards the center axis of said cylinder, said shelves being adapted to lift the raisins from the bottom of the rotatable screened cylinder as it rotates and dropping the raisins to the bottom as each shelf approaches the top, and before the center line of the rotating cylinder;

an elongated trough longitudinally disposed inside of said rotatable cylinder and positioned to far side of said centerline of said cylinder relative to the direction of rotation;

a back shield vertically disposed along the side of said trough on the side nearest the centerline of said rotatable screened cylinder;

means disposed on the outside of said rotating cylinder and in alignment with said trough for directing a spray of water under pressure against the outside of said screen to dislodge spoiled raisins stuck to the screen causing them to be forced thereupon and against said back shield and into said trough; and an outlet chute disposed at the bottom end of said rotating cylinder to allow sound raisins to exit through said chute.

17. The apparatus as defined in claim 16 and further including further means disposed on the inside of said rotatable screened cylinder for directing a spray of water against the inside of said screened cylinder causing the spoiled raisins to become lodged on the screen of said screened cylinder, said further means being disposed along a line near the bottom of said cylinder offset from the side of the centerline thereof.

18. The apparatus as defined in claim 16 and further including:

a vertical track disposed around the outer periphery of the rotatable screened cylinder, and at least one stabilizing wheel being rotatably mounted to said mounting means and against said vertical track.

19. The apparatus as defined in claim 16 and wherein means for rotating said screened cylinder being at least one shaft coupled to one wheel of each pair of wheels disposed on one side rotatable cylinder and being journalled to said mounting structure and motor means for rotating said shaft.

20. The apparatus as defined in claim 19 and further including:

means disposed on the inside of said rotatable screened cylinder for directing a spray of the water against the inside of screened cylinder causing the spoiled raisins to become lodged on the screened of said screen cylinder, and being disposed along a line near the bottom of said cylinder offset from the side of centerline thereof;

a vertical track disposed about the outer periphery of the rotatable screened cylinder; and at least one stabilizing wheel being rotatably mounted to said mounting means and against said vertical track to maintain said cylinder in a stationary rotating plane on the bed formed by said two pair of spaced wheels on said mounting structure.

* * * * *